United States Patent [19]

Selby

[11] Patent Number: 4,831,958

[45] **Date of Patent: * May 23, 1989**

[54] MOBILE SEALANT APPLICATOR FOR ROAD JOINTS AND CRACKS

[75] Inventor: Russell D. Selby, Houston, Ohio

[73] Assignee: Schess Equipment Co., Inc., Piqua, Ohio

[ * ] Notice: The portion of the term of this patent subsequent to Mar. 22, 2005 has been disclaimed.

[21] Appl. No.: 169,882

[22] Filed: Mar. 18, 1988

Related U.S. Application Data

[63] Continuation-in-part of Ser. No. 31,423, Mar. 30, 1987, Pat. No. 4,732,109.

[51] Int. Cl.[4] ..... B05C 11/02

[52] U.S. Cl. ..... 118/108; 118/305; 118/713; 404/111

[58] Field of Search ..... 118/713, 108, 305; 404/107, 108, 111; 222/146.2

[56] References Cited

U.S. PATENT DOCUMENTS

| | | | |
|---|---|---|---|
| 2,420,410 | 5/1947 | Blankner | 404/107 X |
| 2,578,080 | 12/1951 | Middlestadt | 404/107 |
| 3,227,055 | 1/1966 | Glade | 404/107 |
| 3,841,779 | 10/1974 | Ray | 404/111 |
| 3,873,227 | 3/1975 | Goethe et al. | 404/107 |
| 4,653.424 | 3/1987 | Schloss et al. | 118/108 |
| 4,732,109 | 3/1988 | Selby | 118/108 X |

*Primary Examiner*—Shrive Beck
*Assistant Examiner*—Alain Bashore
*Attorney, Agent, or Firm*—Jacox & Meckstroth

[57] ABSTRACT

An asphalt sealant material is heated within an insulated box-like container supported by a front caster wheel and a pair of thin disk-like steel side wheels. A push-type handle bar projects rearwardly and upwardly from the container which has an inner bottom wall sloping downwardly to a side discharge tube. A burner tube extends through a surrounding heater tube located within the lower portion of the container, and a heat exchange oil is confined within the annular space defined between the tubes. A propane fuel tank is supported by a platform projecting rearwardly from the container and is connected by a flexible hose to a nozzle located at the front or the rear of the burner tube. The rear of the burner tube connects with a vertical exhaust pipe, and the rear of the heater tube connects with an oil fill tube. The sealant discharge tube receives a valve tube rotatable by a control rod extending from the handle bar, and another control rod raises and lowers a squeegee member supported for vertical movement behind a bottom outlet within the discharge tube. In a modification, the front of the burner tube exhausts onto the valve tube and sealant discharge tube, and the oil fill tube has a downwardly projecting overflow tube.

17 Claims, 2 Drawing Sheets

MOBILE SEALANT APPLICATOR FOR ROAD JOINTS AND CRACKS

RELATED APPLICATION

This application is a continuation-in-part of application Ser. No. 031,423, filed Mar. 30, 1987, U.S. Pat. No. 4,732,109.

BACKGROUND OF THE INVENTION

In the art of filling or sealing cracks and joints within a concrete or asphalt roadway surface, it is common to use a hand carried funnel-like container or bucket-like container with a spout for manually dispensing a heated asphalt sealant material. There has also been constructed a mobile applicator which includes a frame supported by a pair of rubber tires and which carries a cylindrical bucket or container for receiving the asphalt sealant material. The container has a side discharge port and is heated by a burner connected to a propane fuel tank also carried by the frame.

SUMMARY OF THE INVENTION

The present invention is directed to an improved mobile asphalt sealant applicator which is convenient to use and provides for heating a supply or batch of asphalt filler or sealant material. The apparatus of the invention also provides for precisely controlling the dispensing or discharge of the heated sealant material and for uniformly heating the material to avoid burnout of any rubber component within the material. In addition, the apparatus of the invention provides for rapidly and efficiently applying the heated sealant material either flush with road surface or in a strip with a rounded bead surface.

In accordance with a preferred embodiment of the invention, a box-like container has inner and outer sheet steel walls forming a sealant receiving chamber closed by a pivotal top cover. An insulation material is confined between the inner and outer walls, and the inner bottom wall slopes downwardly to a side discharge tube. The container is supported by a pair of steel disk-like side wheels and a front caster wheel, and a handle bar projects rearwardly and upwardly from the container.

A propane tank is supported by a platform at the rear of the container and supplies fuel to a nozzle located at the front or rear of the container for directing a flame through a burner tube extending through a surrounding heater tube within the lower portion of the chamber. Oil is confined within the annular space between the burner tube and the heater tube and provides for uniform heating of the asphalt sealant material within the chamber. A rotary valve tube controls the flow of sealant from a bottom outlet within the discharge tube and in front of a pivotally supported squeegee member. The hot exhaust gas from the burner tube is discharged onto the discharge and valve tubes. Finger tip control rods operate the valve tube and position of the squeegee member for conveniently controlling the application of the hot asphalt sealant material as the apparatus is pushed along a road surface.

Other features and advantages of the invention will be apparent from the following description, the accompanying drawing and the appended claims.

DESCRIPTION OF THE PREFERRED EMBODIMENT

Figure 1:
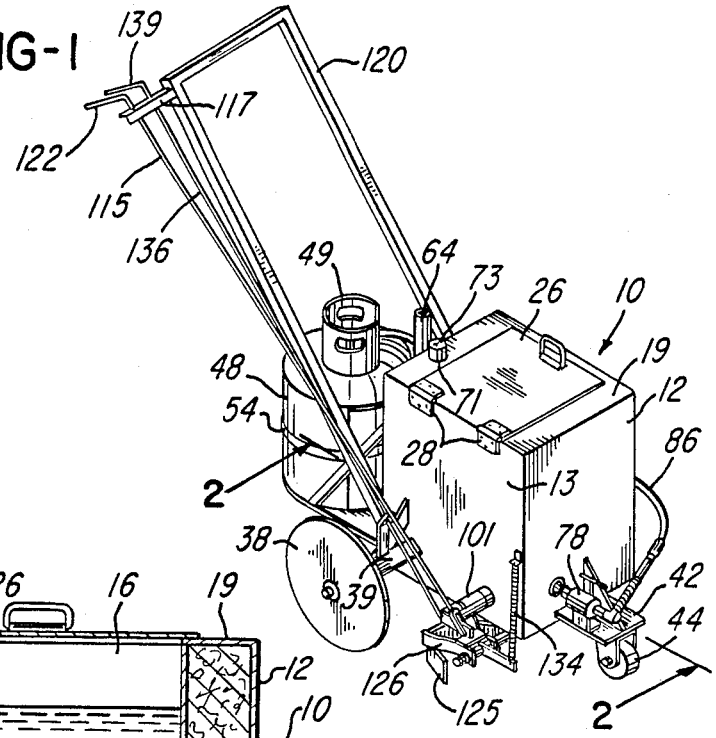
FIG. 1 is a perspective view of a mobile sealant applicator constructed in accordance with the invention.
Figure 3:
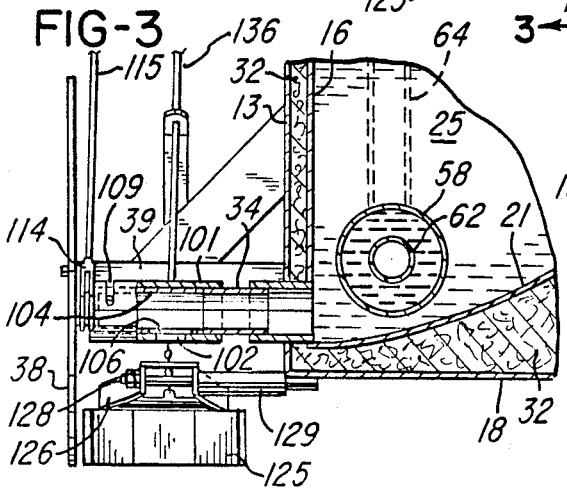
FIG. 3 is a fragmentary section taken generally on the line 3—3 of FIG. 2.

The applicator apparatus illustrated in FIG. 1 includes a box-like insulated container 10 having outer end walls 12 and side walls 13 surrounding corresponding inner walls 14 and 16. The outer walls 12 and 13 are connected by a bottom wall 18 and a top frame-like wall 19, and the inner walls 14 and 16 are connected by a sloping inner bottom wall 21 (FIG. 3). All of the walls are formed from 16 gage steel sheet welded together to form an insulated inner rectangular chamber 25 having a top opening normally covered by a door 26 connected by a pair of hinges 28. The space or cavity defined between the inner and outer walls is filled with a fiber glass insulation material 32, and a discharge pipe or tube 34 projects laterally from the bottom of the chamber 25, as shown in FIG. 3.

The insulated container 10 is supported by a pair of steel disk-like side wheels mounted on axles supported by brackets 39 attached to the outer side walls 13 of the container. A bracket 42 (FIG. 2) projects from the front of the container 10 and carries a front caster or swivel wheel 44. A platform 46 projects rearwardly from the bottom wall 18 of the container 10 to support a propane fuel tank 48 having a top regulator valve (not shown) enclosed within a protector sleeve 49. A curved vertical wall 52 is secured to the platform 46, and a removable band or strap 54 secures the propane tank 48 to the wall 52.

Figure 2:
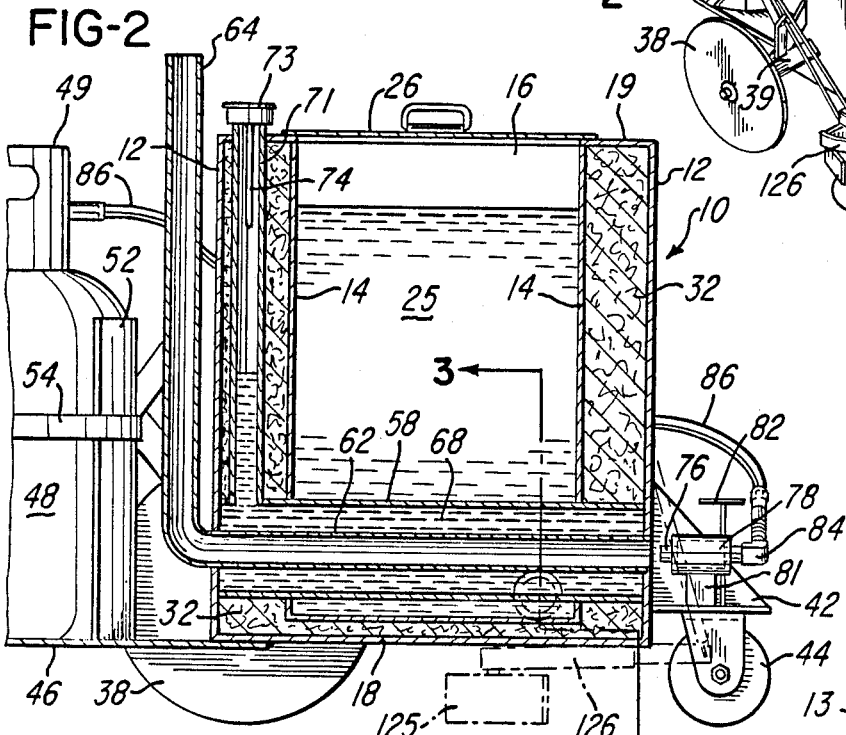
FIG. 2 is a section of the applicator as taken generally on the line 2—2 of FIG. 1.

As shown in FIGS. 2 and 3, a steel heater tube 58 extends between the front and rear outer walls 12 of the container 10 and surrounds a concentric burner tube 62. The burner tube extends reawardly from the front outer wall 12 through the rear outer wall 12 and then upwardly to form an exhaust pipe or tube 64. A sealed annular space 68 is defined between the heater tube 58 and the inner burner tube 62 and is filled with a heat exchange liquid or oil supplied through a fill tube 71 projecting upwardly between the rear walls 12 and 14 through the top wall 19 of the container 10. A temperature indicating thermometer 73 is carried by the upper end of the oil fill tube 71 and has a probe 74 projecting down into the tube 71 and into the oil within the tube 71 to indicate the temperature of the oil within the chamber 68.

A nozzle tube 76 is supported in alignment with the forward end of the burner tube 62 by a surrounding support tube 78. The tube 78 provides a wind shield to air supply holes (not shown) within the nozzle tube 76 and is supported by a bracket 81 removably mounted on the bracket 42 by a bolt with a "T" handle 82. The forward end of the nozzle tube 76 is connected by a fitting 84 and a flexible hose 86 to the regulator valve on the propane tank 48.

Figure 4:
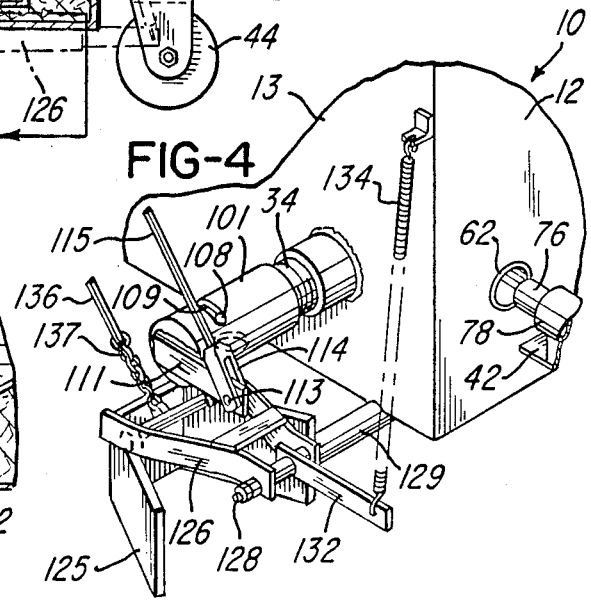
FIG. 4 is an enlarged fragmentary perspective view showing the discharge control valve and applicator squeegee member.

Referring to FIGS. 3 and 4, the sealant discharge tube 34 supports a stationary discharge sleeve 101 having a bottom circular outlet 102. A valve member or tube 104 is supported for rotation within the sleeve 101 and also has a circular discharge opening or outlet 106. When the valve tube 104 is rotated to an open position where the outlet 106 aligns with the outlet 102, the heated asphalt sealant flows through the outlet tube 34 and is discharged or dispensed onto the road surface. The angle of rotation of the valve tube 104 is limited by movement of a screw 108 threaded into the valve tube and confined within an arcuate slot 109 within the surrounding discharge sleeve 101.

A lever 111 (FIG. 4) is secured to the outer closed end of the valve tube 104 and is connected by a pivot pin 113 to a yoke fitting 114 secured to the forward end of a control member or rod 115. The upper end portion of the control rod 115 is supported by a bracket 117 projecting laterally from a U-shaped handle bar member 120 secured to the outer side walls 13 of the container 10. The control rod 115 has an angular tip portion 122 (FIG. 1) which is gripped by the operator to move the rod 115 axially for rotating the valve tube 104 to open and close the discharge outlet 102.

As shown in FIGS. 3 and 4, a rigid metal sqeegee member 125 is rigidly secured to an arm 126 pivotably supported by a shaft 128 projecting axially from a cylindrical stud 129 secured to the outer bottom wall 18 of the container 10. A lever 132 is secured to the arm 126 and receives a tension spring 134 connected to the container 10 for normally biasing or urging the squeegee member 125 downwardly into sliding contact with the road surface. Another control member or rod 136 has a lower end connected to the squeegee member 125 by flexible chain 137. The upper end of the control rod 136 has an angular tip portion 139 for moving the rod 136 axially to raise the squeegee member 125 against the bias of the spring 134 when it is desired to elevate the squeegee member to a retracted and ineffective position.

Figure 5:
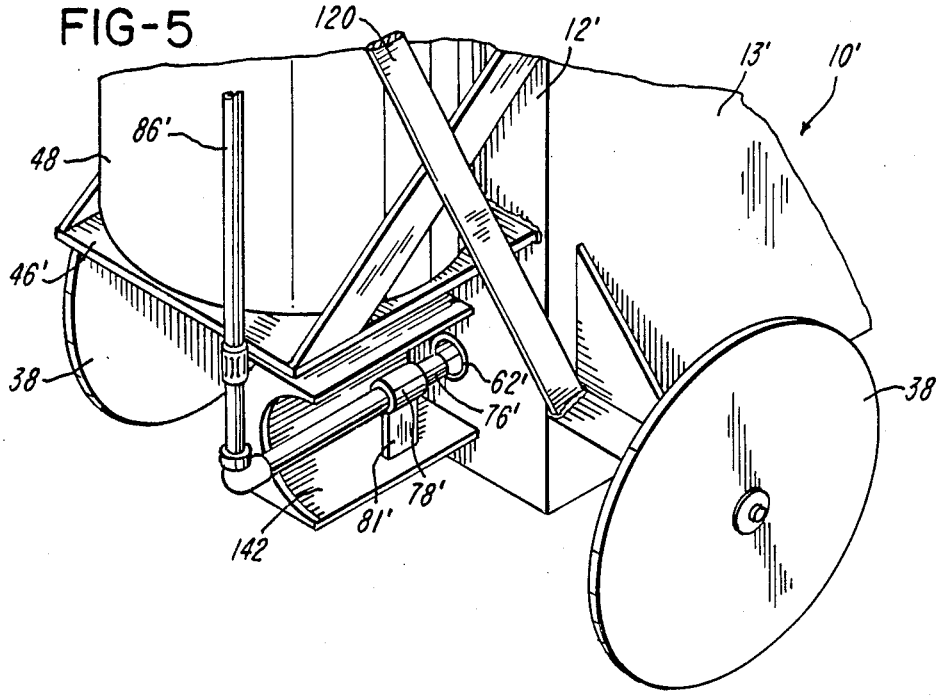
FIGS. 5 and 6 are fragmentary perspective views of a mobile sealant applicator constructed in accordance with a modification of the invention.
Figure 6:
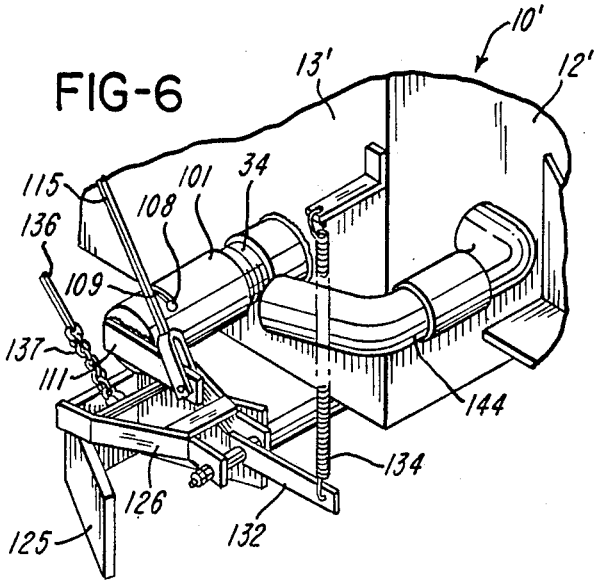

Referring to FIGS. 5 and 6 which show a modification of the mobile applicator apparatus described above in connection with FIGS. 1–4, a burner tube 62' is cut off at the rearward end wall 12' of the container 10', and the vertical exhaust tube 64 is eliminated. A burner nozzle 76' is supported in axial alignment with the burner tube 62' by a surrounding support tube 78' and a bracket 81'. The bracket 81' is welded to a C-shaped bracket 142 which is welded to the rear wall 12' of the container directly under the platform 46' supporting the propane fuel tank 48. A flexible hose 86' connects the nozzle tube 76' to the regulator valve on top of the tank 48.

The forward end portion of the burner tube 62' connects with a U-shaped exhaust duct or tube 144 which receives the gas exhausted from the burner tube 62 and discharges the gas onto the sealant discharge tube 34 and rotary valve tube or sleeve 101. Thus instead of exhausting the gas from the burner tube 62 upwardly through the exhaust pipe or tube 64, as shown in FIG. 2, the modification shown in FIGS. 5 and 6 utilizes the hot exhaust gas to heat the discharge tube 34 and valve sleeve 101. As a result, the sealant being discharged or confined within the discharge tube is maintained at a sufficiently high temperature to prevent partial solidification of the sealant in colder weather, especially when the valve sleeve 101 is in its closed position.

Figure 7:
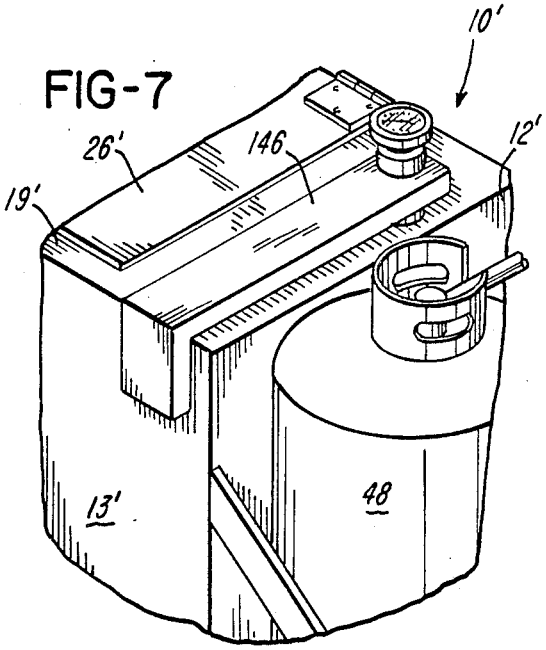
FIG. 7 is another fragmentary perspective view of a modified applicator.

Referring to FIG. 7, it has been determined that when the mobile applicator of the invention is not being used and in storage, it is possible for moisture to condense within the oil fill tube 71 and in the heater tube 58. When the oil within the annular chamber 68 is heated by the burner tube 62 or 62', the condensation escapes as vapor through the fill tube 71, and the vapor could carry with it droplets of hot oil. As shown in FIG. 7, an L-shaped overflow tube 146 receives the upper end portion of the fill tube 71 and is effective to discharge any steam or hot oil droplets downwardly towards the road surface along the side wall 13' of the container 10. Preferably, the overflow tube 146 has a rectangular cross-sectional configuration, and the top wall of the tube 146 has a small hole for receiving the probe 74 of the thermometer 73.

From the drawings and the above position, it is apparent that mobile applicator apparatus constructed in accordance with the present invention, provides desirable features and advantages. For example, the location of the heater tube 58 within the lower portion of the insulated container chamber 25 and the use of the heat exchange liquid or oil within the chamber 68 surrounding the burner tube 62, provide for efficiently heating the asphalt sealant material within the chamber 25 and for obtaining a uniform temperature of the material. By observing the thermometer 74, the regulator controlling the flow of propane fuel to the nozzle 76 may be precisely adjusted to select the optimum temperature for the sealant material.

The sealant discharge valve and its operation with rod 115 from the handle 120 also permits the operator to control precisely the discharge flow rate of the heated sealant through the outlet 102 while the operator is viewing the flow and pushing the mobile applicator along a path where the outlet 102 is located directly above a crack or joint within the road surface. With the use of the control rod 136, the operator may also conveniently select when to use the squeegee member 125 so that the sealant material may be applied flush with the road surface or, when the squeegee member is elevated, in the form of a bead of sealant material over the crack or joint. In addition, the steel disk wheels 38 minimize the build-up of material on the wheels, and if any small amount of material does accumulate on the outer peripheral edge surfaces of the wheels, the material may be burned off with the flame discharged from the nozzle tube 76 or 76' after the nozzle tube is removed from its support tube 78 or 78'. The burner arrangement shown in FIGS. 5 and 6 also provides for discharging the hot exhaust gas onto the sealant discharge tube and the valve sleeve to avoid any solidification of the sealant within the discharge tube and to assure operation of the valve sleeve without sticking.

While the forms of applicator apparatus herein described constitute preferred embodiments of the invention, it is to be understood that the invention is not limited to these precise forms of apparatus and that changes may be made therein without departing from the scope and spirit of the invention as defined in the appended claims.

The invention having thus been described, the following is claimed:

1. Mobile applicator apparatus for applying a fluid sealant to cracks and joints in a road surface, comprising a container having means defining a chamber for receiving a supply of the sealant, a set of wheels supporting said container for movement along the surface and including a pair of disk-like side wheels each having a thin outer peripheral surface, a handle member projecting from said container, an elongated burner tube extending through a portion of said container, means defining a heater chamber around said burnertube, means for supplying a heat exchange liquid to said heater chamber, a fuel burner nozzle for directing a flame axially into said buner tube to heat the heat exchange liquid and the fluid sealant within said container, a discharge tube extending from a lower portion of said container and having an outlet for discharging the heated sealant from said container, a valve member associated with said discharge tube and movable between open and closed positions, control means for manually moving said valve member to control the flow of heated sealant from said outlet, means mounted on said container for supporting a propane fuel tank, a line connecting said propane fuel tank to said nozzle, and a squeegee member disposed rearwardly of said outlet adjacent the road surface for spreading the sealant discharged from said outlet onto the surface when said valve member is in said open position.

2. Apparatus as defined in claim 1 wherein said container comprises inner walls disposed within outer walls and spaced to define a cavity therebetween, a heat insulation material disposed within said cavity, and said means defining said heater chamber comprise a heater tube disposed within said container inwardly of said inner walls for receiving the fluid sealant completely around said heater tube.

3. Apparatus as defined in claim 1 wherein said container has an inclined bottom wall sloping downwardly in a lateral direction toward said discharge tube, and said means defining a heater chamber comprise a heater tube disposed adjacent a lower portion of said inclined bottom wall.

4. Apparatus as defined in claim 1 wherein said set of wheels comprise a front swivel-type caster wheel disposed forwardly of said side wheels, and said handle member is inclined upwardly in a rearward direction from said container.

5. Apparatus as defined in claim 1 wherein said valve member comprises a valve tube supported by said discharge tube for rotation, and said control means include a control rod extending generally parallel to said handle member for rotating said valve tube.

6. Apparatus as defined in claim 1 and including an arm member pivotally connected to said container and supporting said squeegee member for generally vertical movement between a lower position engaging the road surface and a retracted elevated position spaced above the road surface.

7. Apparatus as defined in claim 6 and further comprising a control member extending from said handle member, and means connecting said control member to said squeegee member for moving said squeegee member between said lower and elevated positions in response to manual movement of said control member.

8. Apparatus as defined in claim 1 wherein said burner tube extends completely through said container in a direction generally perpendicular to the axis of said wheels, said burner tube having a forward end portion and a rearward end portion, said nozzle is positioned adjacent said rearward end portion, an exhaust tube is connected to said forward end portion of said burner tube, and said exhaust tube is disposed for directing hot exhaust gas from said burner tube onto said valve member and said sealant discharge tube.

9. Mobile applicator apparatus for applying a fluid sealant to cracks and joints in a road surface, comprising a container including means defining a chamber for receiving a supply of the sealant, a set of wheels supporting said container for movement along the surface, a handle member projecting from said container, an elongated burner tube extending through a portion of said container, means defining a heater chamber adjacent said burner tube, means for supplying a heat exchange liquid to said heater chamber, a fuel burner nozzle for directing a flame axially into said burner tube to heat the heat exchange liquid and the fluid sealant within said container, a discharge tube extending from a lower portion of said container and having an outlet for discharging the heated sealant from said container, a valve member associated with said discharge tube and movable between open and closed positions, duct means for directing the hot exhaust gas from said burner tube onto said valve member and said sealant discharge tube, control means for manually moving said valve member to control the flow of heated sealant from said outlet, means mounted on said container for supporting a propane fuel tank, a line connecting said propane fuel tank to said nozzle, and a squeegee member disposed rearwardly of said outlet adjacent the road surface for spreading the sealant discharged from said outlet onto the surface when said valve member is in said open position.

10. Apparatus as defined in claim 9 wherein said container comprises inner walls disposed within outer walls and spaced to define a cavity therebetween, a heat insulation material disposed within said cavity, and said means defining said heater chamber comprise a heater tube disposed within said container inwardly of said inner walls for receiving the fluid sealant completely around said heater tube.

11. Apparatus as defined in claim 9 and further comprising a control rod extending from said handle member, and means connecting said control rod to said squeegee member for moving said squeegee member between a lower position engaging the road surface and a retracted elevated position spaced above the road surface in response to manual movement of said control rod.

12. Apparatus as defined in claim 9 wherein said burner tube extends completely through said container in a direction generally perpendicular to the axis of said wheels, said burner tube having a forward end portion and a rearward end portion, said nozzle is positioned adjacent said rearward end portion, and said duct means include an exhaust tube connected to said forward end portion of said burner tube.

13. Apparatus as defined in claim 9 and including an overflow tube connected to said means for supplying said heat exchange liquid, and said overflow tube has a discharge end directed downwardly towards the road surface.

14. Mobile applicator apparatus for applying a fluid sealant to cracks and joints in a road surface, comprising a container having spaced outer and inner walls defining a sealant chamber for receiving a supply of the sealant, a heat insulation material disposed within the space defined between said outer and inner walls, a set of wheels supporting said container for movement along the surface and including a pair of disk-like side wheels each having a thin outer peripheral surface, a handle member projecting upwardly and rearwardly from said container, an elongated burner tube extending through a portion of said container and having a forward end portion and a rearward end portion, a heater tube surrounding said burner tube and defining a heater chamber therebetween, means for supplying a heat exchange liquid to said heater chamber, a fuel burner nozzle for directing a flame axially into said rearward end portion of said burner tube to heat the heat exchange liquid within said heater chamber and the fluid sealant within said sealant chamber, a discharge tube extending laterally from a lower portion of said container and having an outlet for discharging the heated sealant from said container, a valve member associated with said discharge tube and movable between open and closed positions, control means extending from said handle member for manually moving said valve member to control the flow of heated sealant from said outlet, means connected to the rearward portion of said container for supporting a propane fuel tank, a line connecting said propane fuel tank to said nozzle, an exhaust tube for directing the hot exhaust gas from said forward end portion of said burner tube onto said valve member and said sealant discharge tube, and a squeegee member disposed rearwardly of said outlet adjacent the road surface for spreading the sealant discharged from said outlet onto the surface when said valve member is in said open position.

15. Apparatus as defined in claim 14 and including an arm member pivotally connected to said container and supporting said squeegee member for generally vertical movement between a lower position engaging the road surface and a retracted elevated position spaced above the road.

16. Apparatus as defined in claim 15 and further comprising a control member extending from said handle member, and means connecting said control member to said squeegee member for moving said squeegee member between said lower and elevated positions in response to manual movement of said control member.

17. Apparatus as defined in claim 14 and including an overflow tube connected to said means for supplying said heat exchange liquid, and said overflow tube has a discharge end directed downwardly towards the road surface.

* * * * *